US006227111B1

(12) United States Patent
Dawley et al.

(10) Patent No.: US 6,227,111 B1
(45) Date of Patent: May 8, 2001

(54) IMPRESSION SETTING MECHANISM FOR A PRINTING UNIT

(75) Inventors: Douglas Joseph Dawley, Epping; David John Gagnon, Dover, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/175,962

(22) Filed: Oct. 21, 1998

(51) Int. Cl.[7] ..... B41F 7/02; B41F 9/10; B41F 5/16; B41F 5/18; B41F 13/24

(52) U.S. Cl. ..... 101/218; 101/145; 101/185; 101/247

(58) Field of Search ..... 101/217, 218, 101/247, 177, 179, 180, 181, 182, 184, 185, 139, 140, 142, 143, 144, 145, 137, 175, 183

(56) References Cited

U.S. PATENT DOCUMENTS

| | | | | |
|---|---|---|---|---|
| 1,824,584 | | 9/1931 | Wood . | |
| 2,874,636 | * | 2/1959 | Royer et al. | 101/218 |
| 3,034,429 | * | 5/1962 | Brodie et al. | 101/218 |
| 3,256,812 | * | 6/1966 | Karrenbauer | 101/216 |
| 4,643,090 | * | 2/1987 | McKrell et al. | 101/218 |
| 5,301,609 | | 4/1994 | Guaraldi et al. . | |
| 5,570,634 | * | 11/1996 | Harter | 101/375 |
| 5,901,648 | | 5/1999 | Roland et al. . | |

FOREIGN PATENT DOCUMENTS

| | | |
|---|---|---|
| 19916258A1 | 11/1999 | (DE) . |
| 0193012A2 | 9/1986 | (EP) . |
| 2 229 141 | 9/1990 | (GB) . |

OTHER PUBLICATIONS

Translation of DE 19916258 which was originally provided by applicants in German in the IDS of Mar. 22, 2000.*
European Search Report dated Jan. 20, 2000.
German Patent Office Search Report dated Jan. 20, 2000.

* cited by examiner

*Primary Examiner*—Kimberly Asher
(74) *Attorney, Agent, or Firm*—Burns, Doane, Swecker & Mathis, LLP

(57) ABSTRACT

The present invention is related to a printing unit including a frame (2) and an upper plate cylinder (12) mounted in the frame (2). An upper blanket cylinder (16) is in selective contact with the upper plate cylinder (12), and a lower blanket cylinder (18) forms a nip with the upper blanket cylinder (16). A web (8) passes through the nip. A lower plate cylinder (14) contacts the lower blanket cylinder (18). Impression setting means (60, 62, 82) are assigned to movable housings (40, 44) of the movable cylinders (12, 14, 16). The impression setting means (60, 62, 82) are provided to adjust forces exerted on bearers (20) of the printing unit cylinders (12, 14, 16).

21 Claims, 6 Drawing Sheets

Fig.1
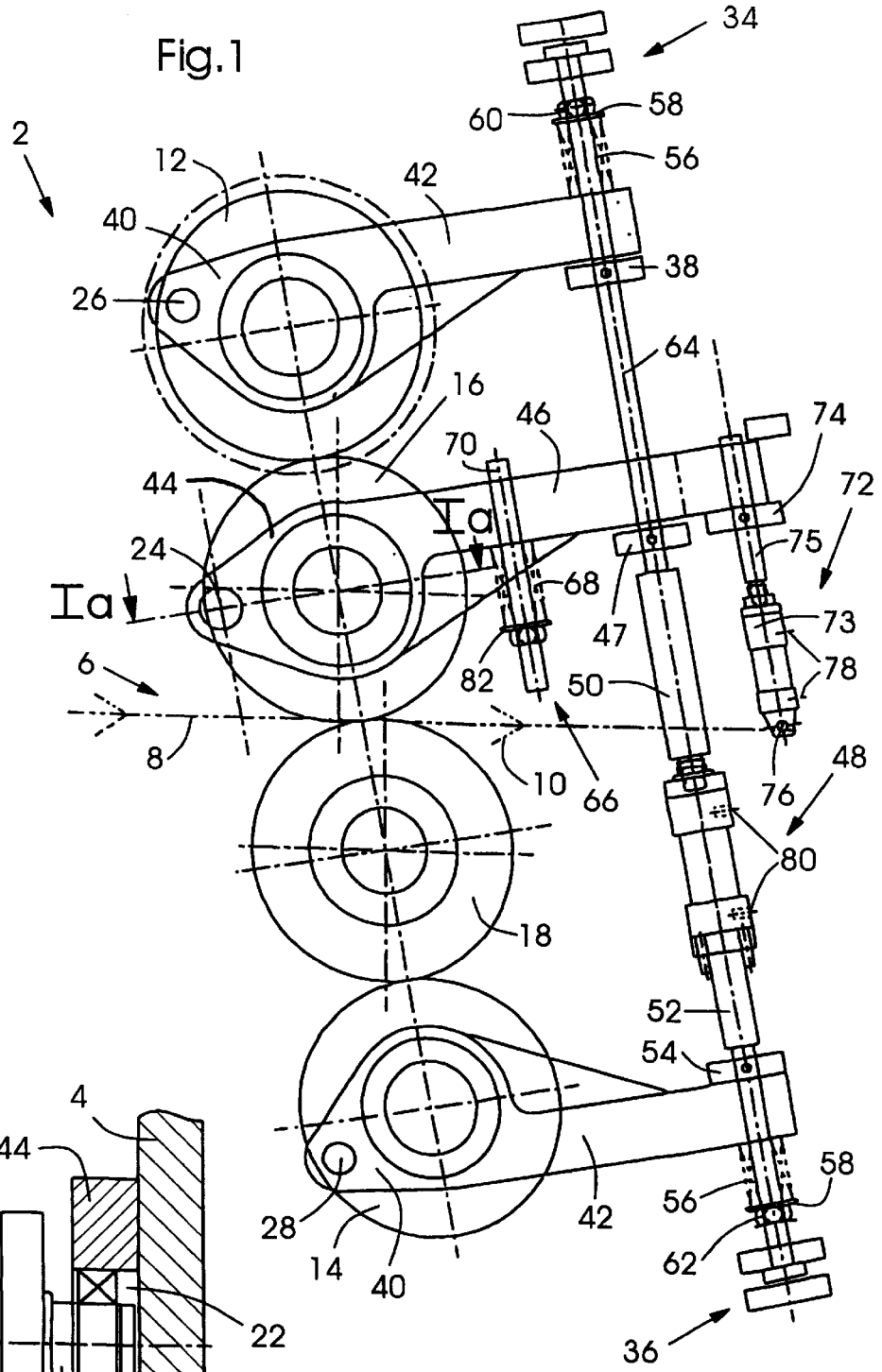
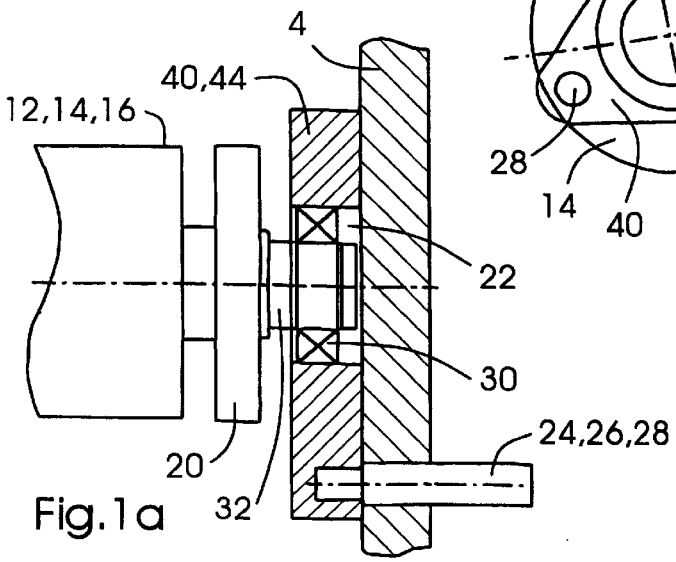
Fig.1a

IMPRESSION SETTING MECHANISM FOR A PRINTING UNIT

FIELD OF THE INVENTION

The present invention is related to an insensitive, reliable impression setting and throw-off mechanism for a printing unit, particularly for a printing unit equipped with bearers.

BACKGROUND OF THE INVENTION

EP 0 193 012 A2 discloses a printing press and method for moving printing cylinders between thrown-off positions in which bearers connected with the cylinders are separated and thrown-on or placed in printing positions. The printing cylinders are urged into thrown-off positions by springs, which in one embodiment of the invention apply a biasing force to pivotally mounted support screws for the cylinders. In another embodiment the cylinders are mounted on cantilevered leaf springs which urge the cylinders towards their thrown-off positions. A motor is provided to apply a force directly to one of the printing cylinders to move it from its thrown-off position to its printing position. The other printing cylinders are moved from their thrown-off positions to their printing positions under the influence of forces transmitted between bearers connected with the printing cylinders.

EP 0 625 423 A1 corresponding to U.S. Pat. No. 5,301,609 discloses a printing unit with skew and throw-off mechanisms. A printing unit includes a frame, first and second brackets, and upper and lower plate cylinders. The first bracket is supported on the frame for movement relative to the frame. The upper plate cylinder has an end supported to move with the first bracket. The second bracket also is supported on the frame for movement relative to the frame, and the lower plate cylinder has an end supported to move with the second bracket. The printing unit also includes a skewing mechanism and a throw-off mechanism. The skewing mechanism moves the brackets transversely relative to the frame independently of each other. The throw-off mechanism pivots the brackets relative to the frame. The throw-off mechanism includes a pressure cylinder and a piston rod connected between the two brackets. The pressure cylinder and the piston rod are pivotally connected to the brackets and move pivotally relative to the brackets when the brackets are moved transversely by the skewing mechanism. The throw-off mechanism thus permits the brackets to be skewed independently of each other, while remaining connected with each other for throw-off.

Pending U.S. patent application Ser. No. 09/103,710 discloses an offset printing press for printing on a web. The press includes a frame, a first plate cylinder movably mounted in the frame, and a first blanket cylinder in selective contact with the first plate cylinder. A second blanket cylinder for forming a nip with the first blanket cylinder is in contact with a second plate cylinder. The press has a first operative condition, wherein the first plate cylinder and the first blanket cylinder are in direct contact with each other when double sided printing on the web is performed. In a second operative condition, the first plate cylinder and first blanket cylinder are separated to permit plates on the first cylinder to be changed while the second plate cylinder and the second blanket cylinder are printing on the web.

Different versions of impression setting are encountered in the technical field related to rotary printing presses. Various throw-off assemblies for bearered printing presses have been publically disclosed for many years, for example throw-off assemblies in various product lines that press manufacturers have long made available. The existing methods of setting impressions are time consuming, difficult to gauge or accurately tune, and require expensive assemblies. To set the desired impression, particularly the bearer squeeze, for each nip in the impression area, existing publically known designs require an operator to rotate a large, eccentric bearing housing by manually adjusting a turnbuckle mechanism or the like. The amount of squeeze attained is very sensitive to the turnbuckle's adjustment. There is no simple method of measuring the resulting impression setting. The eccentric bearing housings used with this method tend to both wear unacceptably over the time and bind in the side frames during adjustment. Due to the unavoidable wear of components, the impression assemblies require periodic readjustment in the field which imposes an unavoidable downtime on the respective printing press.

Separate mechanisms are required both to set the impression and to throw the cylinders off impression. This adds both cost and complexity to the assembly. There are no provisions to separate the blanket cylinders while leaving the plates in contact. Such a feature would allow the printing plates to be changed with the webs still in place.

During normal operation of the machine it is at times necessary to cock each of the plate cylinders with respect to the adjacent blanket cylinder by displacing one end of the plate cylinders. In the existing designs this relative angular motion results in a significant change in impression setting at the movable end of the respective cylinders.

In the past, various attempts have been undertaken to eliminate these deficiencies outlined above. Bearing housings with very small eccentrics have been linked to finely threaded turnbuckles in an attempt to desensitize the adjustment. The resulting, large mechanical advantage tended to make the assemblies self-locking. However when a broken web wrapped the printing cylinders the adjustments would not move or yield, potentially resulting in permanent damage to the printing cylinders. To minimize the binding and the wear at the frame housing interface, the thickness through the bores was increased and complex lubrication assemblies were introduced. This was only partially effective and added significantly to the costs of the respective assemblies.

SUMMARY OF THE INVENTION

In view of the prior art outlined above and the problems encountered in the technical field it is accordingly an object of the present invention to preset impression upon press production and assembly and to avoid readjustment in the field.

Furthermore, it is an object of the present invention to adjust impression setting in an easy way that is relatively insensitive compared to previous designs.

Still another object of the present invention is to eliminate wear of the bearing house and to allow for a cocking of the plate cylinders without affecting the impression settings.

According to the present invention, a printing unit includes a frame, an upper plate cylinder mounted in the frame, an upper blanket cylinder in selective contact with the upper plate cylinder, a lower blanket cylinder for forming a nip with the upper blanket cylinder a web passing the nip, a lower plate cylinder for contacting the lower blanket cylinder, and impression setting means assigned to movable housings of the movable cylinders to adjust forces exerted upon bearers respectively assigned to the printing unit cylinders.

The numerous advantages resulting from the present invention allow for a very easy setting of the impression parameters during assembly of the respective press in the factory. There is no more need for readjustments in the field, once the press is with the customer and has been set up. Now that the bearings of the respective cylinders are mounted in movable housings, bearing house to bearing bore wear in the side frame is eliminated, thus no friction generated corrosion occurs in the side frame of the respective printing unit. As the plate and blanket cylinders are pretensioned by compression springs assigned to the respective cylinder bearing housings, the cylinders can move and yield in the event objects become wedged between the cylinders, for example when a web breaks and becomes wrapped around a cylinder.

In accordance with exemplary embodiments of the present invention, an actuating member is assigned to the movably mounted cylinder/bearing housings and actuates the housings together. The actuating member is mounted in fixed stops that are mounted in the respective side frame of the printing unit. The actuating member is provided with a plurality of stops, each of which cooperates with respective levers of the movable housings. The housing levers are biased by means of compression elements assigned to the impression setting means. The compression means can be compression springs or a plurality thereof arranged in serial or parallel connection; likewise a cup spring arrangement can be used.

The previously mentioned actuation member can be a hydraulic cylinder, or a pneumatic cylinder loaded with a pressurized fluid. Integrated into the actuating member are an upper attachment and a lower attachment, respectively, to which the actuating member provided with the compression means is assigned.

To compensate for the weight of the movable upper blanket cylinder, a spring-biased compensation assembly is assigned to this cylinder. The upper blanket cylinder can be moved by means of a separate actuating member which may comprise a hydraulic or pneumatic cylinder for actuation. This allows the upper blanket cylinder to be separated from the lower blanket cylinder so that the printing plate can be changed with the web in place, i.e., between the blanket cylinders. By means of the separate actuation member, the upper blanket cylinder can be activated or actuated independently of the lower cylinders.

BRIEF DESCRIPTION OF THE DRAWINGS

The foregoing and other features of the present invention will become apparent to those skilled in the art upon reading the following description of preferred embodiments of the invention in view of the accompanying drawings, wherein:

FIG. 1 shows a representation of side view of an impression area.

FIG. 1A shows a cross section of a cylinder assembly along the lines IA—IA shown in FIG. 1.

DESCRIPTION OF THE PREFFERED EMBODIMENTS

Figure 2:
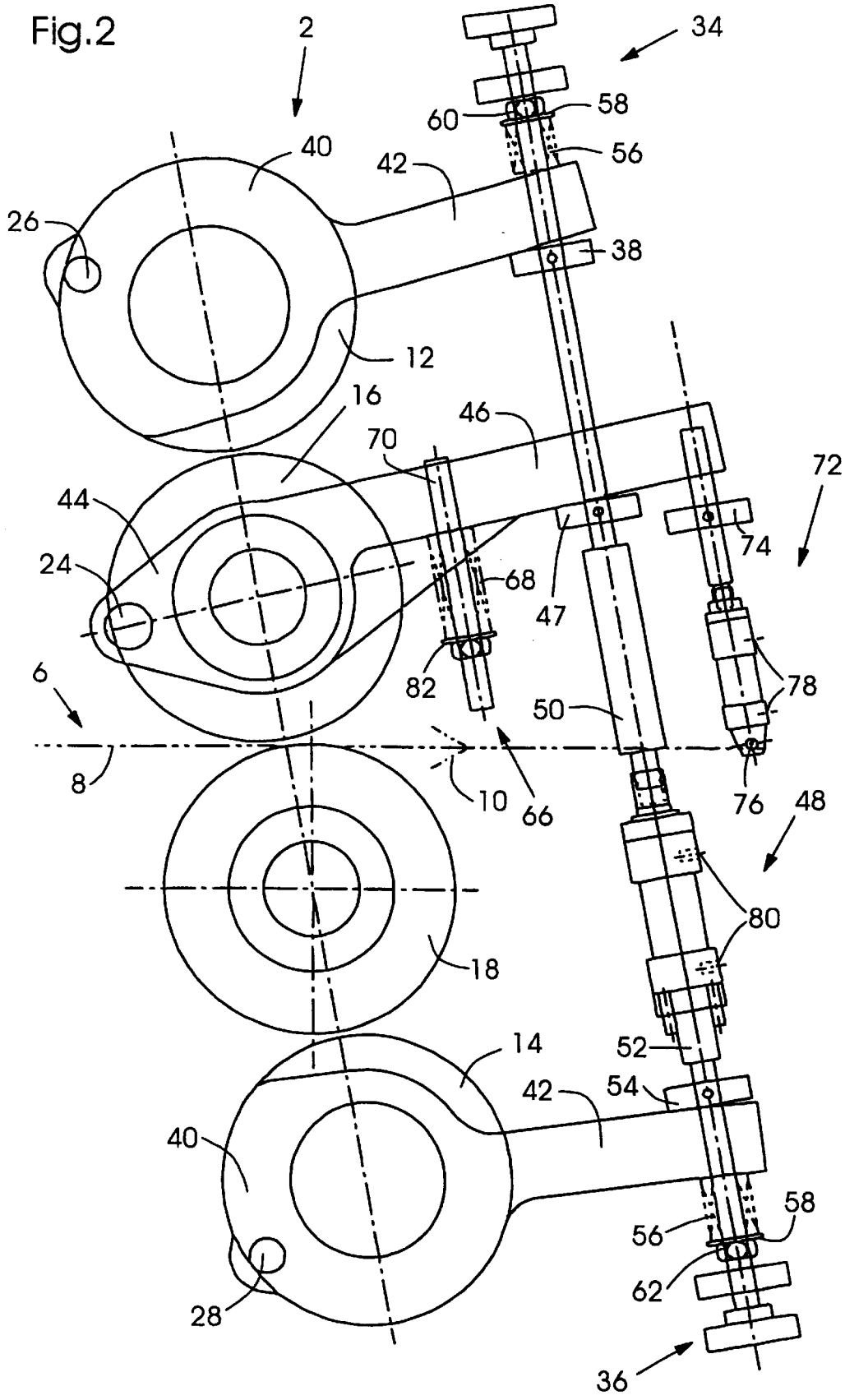
FIG. 2 shows the mechanism of FIG. 1 in the thrown-off condition.

FIG. 1 represents a view of the impression area of a printing unit.

A printing unit 2 comprises an upper printing cylinder pair and a lower printing cylinder pair. The upper printing unit cylinder pair essentially consists of an upper plate cylinder 12 and an upper blanket cylinder 16 both of which are movable about pins 26 and 24, respectively. The lower printing unit cylinder pair essentially consists of a lower blanket cylinder 18 and a lower plate cylinder 14. The lower plate cylinder 14 is movable about a pin 28, as described in greater detail below. The lower blanket cylinder 18 is fixed with respect to a side frame 4 of the respective printing unit 2. A web of material 8 travels in a web travel direction 10 and passes through a nip formed between the surfaces of the movably mounted upper blanket cylinder 16 and the stationary mounted lower blanket cylinder 18. The upper movably mounted plate cylinder 12 is mounted in a plate cylinder bearing housing 40 having a lever 42. The upper blanket cylinder 16 is mounted in a blanket cylinder bearing housing 44 having a lever 46.

In the lower printing unit cylinder pair the lower blanket cylinder 18 is mounted in a stationary fashion so that the rotational axis of the lower blanket cylinder 18 does not move with respect to the side frame 4. The movably mounted lower plate cylinder 14 is journaled in a plate cylinder housing bearing 40 having a lever 42. An actuating assembly including a rod 64 is arranged somewhat inclined with respect to the web travel plane 6. The actuating assembly further includes an actuating assembly 48 having an upper attachment 50 and a lower attachment 52. The actuating assembly 48 may comprise a pneumatic cylinder, a hydraulic cylinder or an electromagnetic device or may even comprise an electric motor or another suitable driving means.

Figure 5:
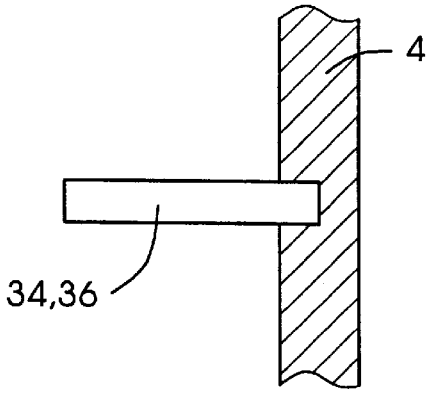
FIG. 5 shows a fixed stop mounted in a side frame of a printing unit, in accordance with an exemplary embodiment of the invention.

The actuating member is mounted between an upper fixed or end stop 34 and a lower fixed or end stop 36. Each of the stops 34, 36 is mounted on a respective side frame 4 of the printing unit 2, for example as shown in FIG. 5. An upper stop 38 is mounted on the rod member 64, and is assigned to the lever 42 of the plate cylinder bearing housing 40 of the upper plate cylinder 12. Above the upper attachment 50 a stop 47 is mounted on the rod member 64. The stop 47 is assigned to the lever member 46 of the blanket cylinder bearing housing 44 for the upper blanket cylinder 16. A lower stop 54 near the lower attachment 52 is assigned to the lever member 42 of the blanket cylinder bearing housing 40.

FIG. 1 further discloses that the blanket cylinder bearing housing 44 can be actuated by a separate actuating member set 72. The separate actuating member set 72 may include a cylinder 73 that is alimented via fluid pipes 78. The actuating member further includes a separate stop 74 which is mounted on a rod 75 extending from the cylinder 73. The separate stop 74 is mounted on the rod 75, so as to contact the lever 46 from its bottom side. The cylinder is journalled in a cylinder mounting 76 mounted in a side frame 4 of the printing unit 2. Furthermore, an additional spring assembly 66 is assigned to the lever 46 of the blanket cylinder bearing housing 44. The additional spring assembly 66 comprises a compression means 68 such as a helical spring which is supported by a disc-shaped element 82. The compression means 68 may be mounted and secured upon a rod element 70, so that the compression element 68 support the lever 46 on its bottom side.

The additional spring assembly 66 is provided to compensate for the additional weight of the upper movable blanket cylinder 16. Since the lower blanket cylinder 18 is mounted in a fixed position with respect to the side plates 4, the actuating assembly 48 is intended to move two upper printing unit cylinders and one lower printing unit cylinder. Thus, the additional spring assembly 66 compensates the additional weight of the upper movable blanket cylinder 16 on the cylinder assembly 48.

FIG. 1A shows schematically how the plate and blanket cylinder housings 40, 44, are mounted in the side frames 4. FIG. 1A shows a view of a portion of the mechanism illustrated in FIG. 1, along the lines IA—IA.

On a stub shaft 32 of the printing unit cylinders 12, 14, and 16, a bearer 20 is mounted. By means of the actuating assembly 48 and the upper and lower pretensioning members 60, 62, the bearer contact is adjustable within a large adjustment range, as will be described below. FIG. 1A shows how the plate or blanket cylinder bearing housing are movably mounted within the side frames 4 of the printing unit 2 so that the cylinder bearing housings 40, 44 can pivot around the pivot pins 24, 26 and 28 to move along a surface of the side frames 4. Within the plate or blanket cylinder bearing housings a respective opening 22 is provided to receive the printing unit cylinder bearing 30. To allow for the movement of the plate or blanket cylinder bearing housings 40, 44 along the surface of the side frames 4, the housings 40, 44 pivot about the fixed pivot pin 24 and the translating pivot pins 26, 28.

FIG. 2 shows the printing unit cylinders of FIG. 1 in a thrown-off position.

In this stage the actuating assembly 48 moves the lower attachment 52 in a downward direction, thus the lower stop 54 moves the lower plate cylinder bearing housing 40 about the translating pivot pin 28. The upper attachment 50 moves in an upper direction, so as to move the stop 47 and the upper stop 38. Consequently, the upper plate cylinder bearing housing 40 and the upper blanket cylinder bearing housing 44 will move and rotate upwards about the fixed pivot pin 24 and the translating pivot pin 26. In this stage the additional spring assembly 66 compensates for the weight of the upper blanket cylinder 16. Since all of the movable cylinders are force-loaded by means of springs 56, 68, the impression settings are not changed significantly upon cocking of the respective plate cylinders 12, 14. Since the plate cylinder bearing housings 40 are journalled in translating pivot pins 26, 28, a cocking movement of the plate cylinders 12, 14 with respect to the blanket cylinders 16, 18 is achievable. In the stage shown in FIG. 2, the second actuating unit 72 is not in use, the three movable cylinders are actuated by the actuating unit 48, and the upper movable blanket cylinder is supported by an additional spring assembly 66.

Figure 3:
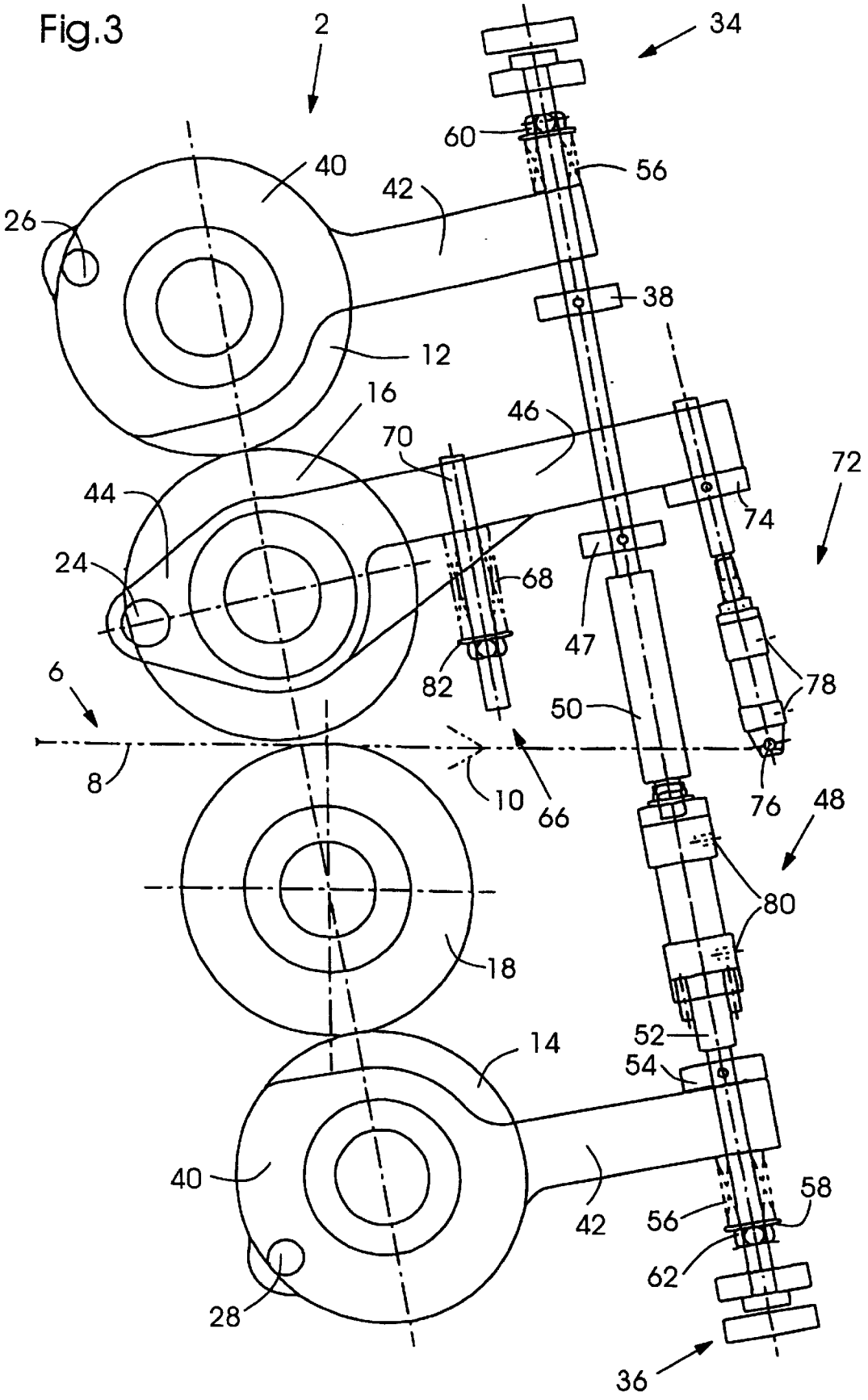
FIG. 3 shows the mechanism of FIG. 1 with only the blanket cylinders only separated.

In FIG. 3 a separate throw-off of the upper movable blanket cylinder 16 is shown.

In this configuration, the upper blanket cylinder bearing housing 44 is moved by a second actuating member 72 via the lever 46. The actuating member 48 is in its inactivated position, thus the separate actuating member 42 impacts on the upper blanket cylinder bearing housing 44 only. As can be seen in FIG. 3, a nip is created between the surface of the upper blanket cylinder 16 and the surface of the lower stationary blanket cylinder 18. Since the blanket cylinders 16, 18, can be independently separated from each other, plate changes can be performed while the web 8 remains in place within the printing unit 2.

Figure 4:
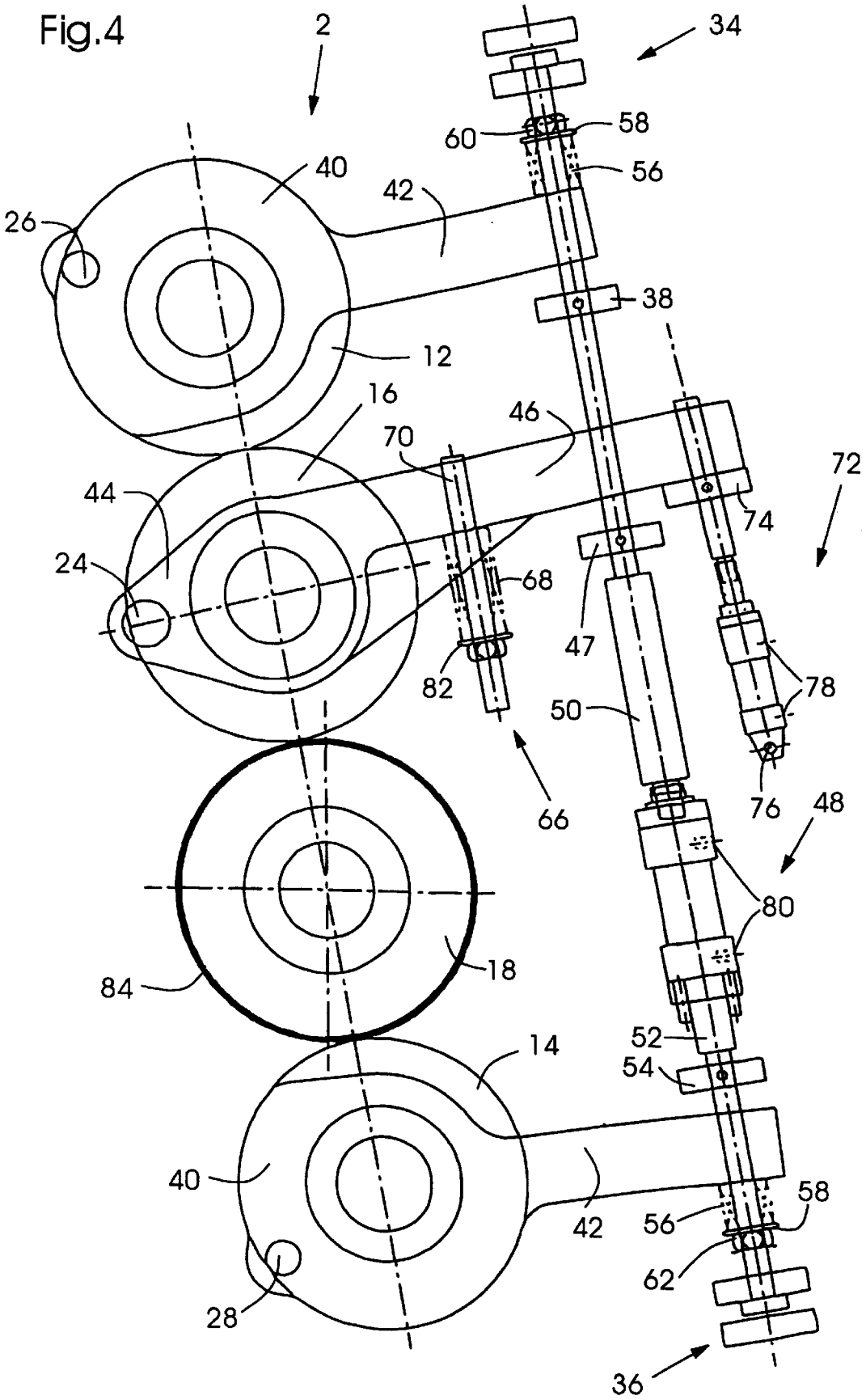
FIG. 4 shows the mechanism of FIG. 1 with a broken web wrapped around the lower blanket cylinder.

In FIG. 4 a partial wrap-up of a web of material on the stationary blanket cylinder is shown.

In this configuration a broken web is partially wrapped around the circumference of the stationary lower blanket cylinder 18. The wrapped portion of the broken web is indicated with reference numeral 84. The wrapped portion of the web 8 increases the outer diameter of the lower blanket cylinder 18 substantially, so as to move the upper plate cylinder 12 and the upper blanket cylinder 16 about the respective pins 24, 26, whereas the lower plate cylinder 14 is moved about its corresponding translating pin 28. The plate cylinders 12, 14 are pretensioned by compression springs 56. The springs 56 allow the cylinders to move about the pins 24, 26, and 28 when an object such as a broken web becomes wedged between the cylinders, thus preventing damage. As can be seen in FIG. 4, the actuating member 48 is in its inactivated position, and the relative movements of the upper plate cylinder 12 and the upper blanket cylinder 16 and of the lower plate cylinder 14 are due only to the increase in the diameter of the stationary blanket cylinder 18.

Given the above-mentioned behaviour of the movable printing unit cylinders 12, 14, and 16, respectively, due to the pretensioned stage of the cylinders a potential wrap-up of a web of material 8 does not damage the cylinders 12, 14, 16, respectively. The pretensioning means 60, 62 arranged above the compression means 56 allow for an easily gauged adjustment of the respective pretensioning force. Thus, a precise pressure between the respective bearers 20 surfaces can be set in the factory. The pressure will not need to be readjusted in the field later on, and the upper and lower plate cylinders can be cocked with respect to their blanket cylinders without adversely affecting the precise pressure. Thus, pre-adjusted impression settings can be maintained while cocking the plate cylinders 12, 14, that are respectively journalled in the translating pivot pins 26, 28. The upper and lower pretensioning means 60, 62 may be nuts, a quarter turn of which changes a bearer contact stripe width by approximately 0.001" which is less than 2% of the full adjustment range. A further advantage of the present invention is the ease with which a required force for an impression setting can be set and gauged. After a predetermined pretensioning or setting force is set, the magnitude of an impression setting can be easily gauged by measuring the position of the upper and lower pretensioning means 60, 62, which can each be a nut, for example.

Figure 6:
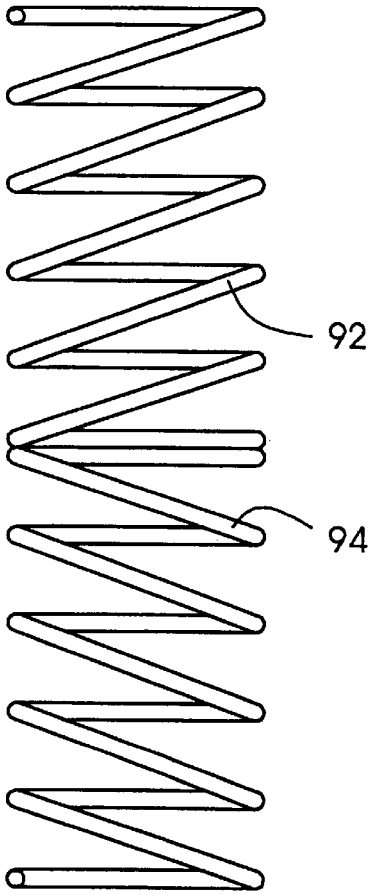
FIG. 6 shows a compression element including a plurality of coil springs mounted in series, in accordance with an exemplary embodiment of the invention.
Figure 7:
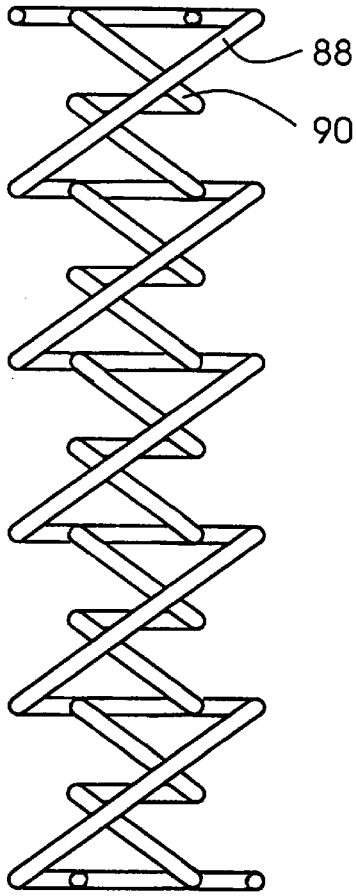
FIG. 7 shows a compression element including a plurality of coil springs mounted in parallel, in accordance with an exemplary embodiment of the invention.

The compression elements 56, 68 can be helical compression springs such as the spring 88 shown in FIG. 7, and can also each be composed of multiple springs in either a parallel configuration as shown in FIG. 7 or a series configuration shown in FIG. 6. FIG. 7 shows two springs 88, 90 in a parallel configuration that also has the spring 90 located concentrically with the spring 88. FIG. 6 shows two springs 92, 94 located end-to-end in a series configuration.

Figure 8:
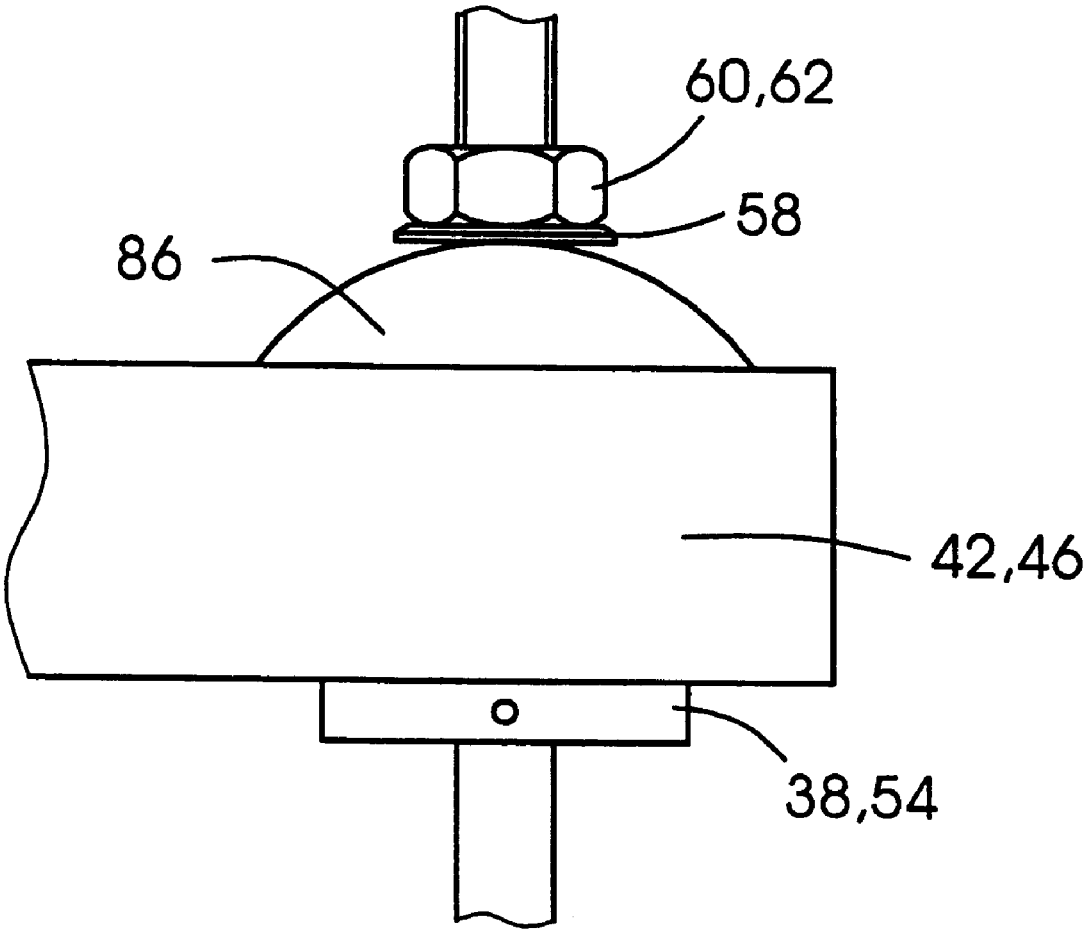
FIG. 8 shows a compression element including a cup spring, in accordance with an exemplary embodiment of the invention.

The compression elements 56, 68 can also include cup springs, an example of which is illustrated in FIG. 8. FIG. 8 shows a cup spring 58 located between the disk element 58 and the lever 42, 46. The impression setting means referred to in the Summary of the Invention above can include, for example, the spring assembly 66, the upper and lower pretensioning members 60, 62, the disk elements 58, 82, and the springs 56, 68.

Without further analysis, the foregoing fully reveals the gist of the present invention so that others can apply current knowledge to readily adapt the present invention for various applications without omitting features that, from the standpoint of prior art, fairly constitute essential characteristics of the generic or specific aspects of this invention. Therefore, such adaptations should and are intended to be comprehended within the meaning and range of equivalence of the following claims.

REFERENCE NUMERAL LIST

2 printing unit
4 side frame
6 web travel plane
8 web
10 web travel direction
12 upper plate cylinder
14 lower plate cylinder
16 upper blanket cylinder
18 lower blanket cylinder (fixed)
20 bearer
22 bracket
24 fixed pivot pin
26 translating pivot pin
28 translating pivot pin
30 bearing
32 stub shaft
34 upper fixed stop
36 lower fixed stop
38 upper stop
40 plate cylinder bearing housing
42 lever
44 blanket cylinder bearing housing
46 lever
47 stop
48 cylinder assembly
50 upper cylinder attachment
52 lower cylinder attachment
54 lower stops
56 compression means
58 disk element
60 upper pretensioning means
62 lower pretensioning means
64 rod
66 additional spring assembly
68 compression means
70 rod
72 second cylinder set
73 cylinder
74 separate stop
75 rod
76 cylinder mounting
78 fluid pipe
80 fluid pipe
82 disk element
84 wrapped web
86 cup spring
88 spring
90 spring
92 spring
94 spring

What is claimed is:

1. Printing unit comprising:

a frame;

an upper plate cylinder mounted in the frame;

an upper blanket cylinder in selective contact with the upper plate cylinder;

a lower blanket cylinder for forming a nip with the upper blanket cylinder;

a web passing through the nip;

a lower plate cylinder for contacting the lower blanket cylinder;

movable bearing housings for the upper plate, lower plate, and upper blanket cylinders, wherein the movable bearing housings for the upper and lower plate cylinders pivot about translatable pivot pins mounted in the frame, and translating the translatable pivot pins with respect to the frame cocks the upper and lower plate cylinders with respect to the upper and lower blanket cylinders; and impression setting means assigned to the movable bearing housings of the upper plate, lower plate, and upper blanket cylinders for adjusting a force exerted upon bearers assigned to the upper plate, lower plate, and upper blanket cylinders.

2. Printing unit comprising:

a frame;

an upper plate cylinder;

a lower plate cylinder;

an upper blanket cylinder;

a lower blanket cylinder; and a movable housing for each of the upper plate cylinder, the lower plate cylinder and the upper blanket cylinder, wherein the upper plate cylinder is pivotally attached to the frame via the corresponding movable housing, and the upper plate cylinder rotates within the corresponding movable housing, the lower plate cylinder is pivotally attached to the frame via the corresponding movable housing, and the lower plate cylinder rotates within the corresponding movable housing, the lower blanket cylinder is fixedly mounted in the frame between the upper and lower plate cylinders, and the upper blanket cylinder is pivotally attached to the frame, via the corresponding movable housing, between the upper and lower plate cylinders adjacent to the lower blanket cylinder, and the upper blanket cylinder rotates within the corresponding movable housing and forms a nip with the lower blanket cylinder;

a web passing through the nip formed by the lower blanket cylinder and the upper blanket cylinder;

an actuating member that is extendible and contractible; and a plurality of compression means arranged on the actuating member to bias the movable housings so that a) when the actuating member is contracted, the compression means bias the movable housings of the upper and the lower plate cylinders toward the upper blanket cylinder and lower blanket cylinder, respectively, and b) when the actuating member is extended, the upper plate cylinder and the lower plate cylinder are separated from the upper and lower blanket cylinders, respectively.

3. Printing unit according to claim 2, further comprising stops fixed on the frame that limit a maximum extension of the actuating member.

4. Printing unit according to claim 2, further comprising stops arranged on the actuating member so that when the actuating member is extended, the stops force the upper plate cylinder and the lower plate cylinder away from the upper and lower blanket cylinders respectively, and force the upper blanket cylinder away from the lower blanket cylinder.

5. Printing unit of claim 4, wherein a first one of the stops arranged on the actuating member is located adjacent to the movable housing of the upper plate cylinder, a second one of the stops arranged on the actuating member is located adjacent to the movable housing of the upper blanket cylinder, and a third one of the stops arranged on the actuating member is located adjacent to the movable housing of the lower plate cylinder.

6. Printing unit of claim 4, wherein:

a first one of the stops and a first one of the plurality of compression means correspond to the movable housing of the upper plate cylinder;

the first one of the stops transfers force to the movable housing of the upper plate cylinder in a first direction, and the first one of the plurality of compression means transfers force to the movable housing of the upper plate cylinder in a second direction opposite to the first direction;

a second one of the stops and a second one of the plurality of compression means correspond to the movable housing of the lower plate cylinder; and the second one of the stops transfers force to the movable housing of the lower plate cylinder in the second direction, and the second one of the plurality of compression means transfers force to the movable housing of the lower plate cylinder in the first direction.

7. Printing unit according to claim 2, wherein the compression means comprises compression springs.

8. Printing unit according to claim 2, wherein the compression means comprises cup springs.

9. Printing unit according to claim 2, wherein the compression means comprises a plurality of compression springs.

10. Printing unit according to claim 9, wherein the compression springs are mounted in series.

11. Printing unit according to claim 9, wherein the compression springs are mounted in parallel.

12. Printing unit according to claim 2, further comprising an actuating assembly for activating the actuating member.

13. Printing unit according to claim 12, wherein the actuating assembly comprises a hydraulic cylinder.

14. Printing unit according to claim 12, wherein the actuating assembly comprises a pneumatic cylinder.

15. Printing unit according to claim 12, wherein the actuating assembly comprises at least one of a fluid driven motor and an electrical motor.

16. Printing unit according to claim 12, wherein the actuating assembly comprises an upper attachment and a lower attachment and is connected between upper and lower segments of the actuating member via the upper and lower attachments respectively.

17. Printing unit according to claim 2, wherein the printing unit further comprises a spring assembly for biasing the movable housing for the upper blanket cylinder to pivot the upper blanket cylinder toward the upper plate cylinder.

18. Printing unit according to claim 2, wherein the movable housing for the upper blanket cylinder pivots about a pivot pin fixed to the frame.

19. Printing unit according to claim 2, further comprising at least one separate actuating member connected at one end to the frame and at the other end to the movable housing of the upper blanket cylinder, and arranged to pivot the upper blanket cylinder away from the lower blanket cylinder and create a gap between only the upper blanket cylinder and the lower blanket cylinder.

20. Printing unit according to claim 19, wherein each at least one separate actuating member includes a separate stop for exerting force on the movable housing of the upper blanket cylinder to pivot the upper blanket cylinder.

21. Printing unit comprising:

a frame;

an upper plate cylinder mounted in the frame;

an upper blanket cylinder in selective contact with the upper plate cylinder;

a lower blanket cylinder for forming a nip with the upper blanket cylinder;

a web passing through the nip;

a lower plate cylinder for contacting the lower blanket cylinder; and impression setting means assigned to movable bearing housings of the upper plate, lower plate, and upper blanket cylinders for adjusting a force exerted upon bearers assigned to the upper plate, lower plate, and upper blanket cylinders, the impression setting means including compression means for exerting force on the movable housings of the upper and lower blanket cylinders;

wherein the compression means is adjustable to vary the force exerted by the compression means on the movable housings of the upper and lower plate cylinders.

* * * * *